US010076190B2

(12) United States Patent
Atkinson et al.

(10) Patent No.: US 10,076,190 B2
(45) Date of Patent: Sep. 18, 2018

(54) PILLOW

(71) Applicant: DG International Holdings Limited, London (GB)

(72) Inventors: Benjamin Atkinson, Chipperfield (GB); Jean-Philippe Henri Denat, London (GB)

(73) Assignee: DG International Holdings Limited, London (GB)

( * ) Notice: Subject to any disclaimer, the term of this patent is extended or adjusted under 35 U.S.C. 154(b) by 309 days.

(21) Appl. No.: 14/937,465

(22) Filed: Nov. 10, 2015

(65) Prior Publication Data

US 2017/0042332 A1 Feb. 16, 2017

(30) Foreign Application Priority Data

Aug. 11, 2015 (GB) ..... 1514182.3

(51) Int. Cl.
*A47C 7/38* (2006.01)

(52) U.S. Cl.
CPC ..... *A47C 7/383* (2013.01)

(58) Field of Classification Search
CPC ..... A47C 7/38
USPC ..... 5/636, 640, 632, 630
See application file for complete search history.

(56) References Cited

U.S. PATENT DOCUMENTS 4,030,781 A 6/1977 Howard
4,114,948 A 9/1978 Perkey
4,285,081 A * 8/1981 Price ..... A47C 7/383 297/391
4,738,488 A 4/1988 Camelio
4,763,369 A * 8/1988 Spector ..... A47G 9/1045 446/369
5,154,477 A 10/1992 Lacy
5,330,255 A 7/1994 Stawicki
6,010,192 A 1/2000 King
6,299,248 B1 10/2001 Gennaro et al.
6,957,462 B1 10/2005 Wilcox
2008/0036253 A1 2/2008 Lee
2010/0194166 A1 8/2010 Grenier
2014/0310877 A1 * 10/2014 Sternlight ..... A47G 9/10 5/639
2015/0059098 A1 3/2015 Jung
(Continued)

FOREIGN PATENT DOCUMENTS

CN 203088260 U 7/2013
DE 28 56 366 2/1980
(Continued)

*Primary Examiner* — Fredrick C Conley
(74) *Attorney, Agent, or Firm* — Blank Rome LLP

(57) ABSTRACT

A pillow comprising two wings and a bridging section connecting the wings, so that the wings and bridging section form a substantially U-shaped shape. An elastic member and a connecting assembly connect one portion of the elastic member to a first fixing point on a wing or the bridging section and another portion of the elastic member to a second fixing point on a wing or the bridging section, so that the elastic member or the connecting assembly, or both, can pass from one wing to the other, and the elastic member can urge the wings towards one another. The invention provides a more convenient and quicker way of lengthening the elastic member or connecting assembly passing from one wing to the other.

38 Claims, 7 Drawing Sheets

(56) References Cited

U.S. PATENT DOCUMENTS

| | | | |
|---|---|---|---|
| 2015/0082546 | A1 | 3/2015 | Sternlight et al. |
| 2015/0157134 | A1 | 6/2015 | Ko |

FOREIGN PATENT DOCUMENTS

| | | | |
|---|---|---|---|
| GB | 2 198 241 | A | 6/1988 |
| GB | 2483461 | A | 3/2012 |
| KR | 1020120006946 | U | 10/2012 |
| WO | WO 2009/009091 | A1 | 1/2009 |
| WO | WO 2009/061077 | A2 | 5/2009 |
| WO | WO 2015/138654 | A1 | 9/2015 |

* cited by examiner

PILLOW

BACKGROUND OF THE INVENTION

1. Field of the Invention

The present invention relates to pillows, and more particularly to travel pillows.

2. Description of the Related Art

U-shaped pillows are well known and are a familiar sight at airports. Such pillows are provided with two wings and a bridging section connecting the wings, so that the pillow can be wrapped around the back and sides of the neck of the user to support the user's head.

Many U-shaped pillows suffer from the problem that the wings tend to splay during use, which means that the wings do not provide sufficient support for the head of the user. One solution has been to provide a strap between the free ends of the wings, so that the strap can be fastened during use to prevent the wings splaying and to bring the free ends of the wings together to support the head. Pillows of this type typically use a strap with a hook-and-loop arrangement (for example Velcro®) or a clip, buckle or toggle fastener to fasten the strap.

SUMMARY OF THE INVENTION

The present invention aims to provide an improved pillow.

A first aspect of the present invention provides a pillow comprising two wings; a bridging section connecting the wings so that the wings and bridging section form a substantially U-shaped shape; an elastic member; and connecting means for connecting one portion of the elastic member to a fixing point on a wing or the bridging section and another portion of the elastic member to a fixing point on a wing or the bridging section, so that the elastic member, or the connecting means, or both, can pass from one wing to the other and the elastic member can urge the wings towards one another.

When the user wishes to use the pillow of the first aspect, the user can lengthen the elastic member or combination of elastic member and connecting means passing from one wing to the other by simply pulling on the elastic member or connecting means. The elastic member will then stretch and the wings can be splayed so that the pillow can be wrapped around the back and sides of the user's neck. The user can then stop pulling and the elastic member will return to its original length and will urge the wings towards one another in order to support the head. The first aspect of the invention thus provides a more convenient and quicker way of lengthening the elastic member or connecting means passing from one wing to the other.

When the elastic member or connecting means passes from one wing to the other, the elastic member is under tension. Preferably, the elastic member or connecting means is capable of being disconnected from at least one fixing point so that the elastic member or connecting means does not pass from one wing to the other. Upon such disconnection, for example after use, the tension in the elastic member shortens the elastic member and draws back any part of the connecting means still connected to the elastic member. Thus a shorter length of material is left, leading to a neater arrangement of the pillow when not in use.

An advantage of connecting a portion of the elastic member to the bridging section rather than the wing is that it allows a long elastic member to be used, provided that the elastic member or connecting means passes around or through the tip of a wing before passing from that wing to the other. A longer elastic member is typically able to extend more than a shorter one.

The elastic member is preferably made from a material having a low extension stiffness. For example, the material may have a Young's modulus of less than or equal to 0.1 GPa, more preferably, less than or equal to 0.05 GPa, more preferably, less than or equal to 0.01 GPa, at small strains. Suitably, the elastic member is made from an elastomeric material such as rubber. Suitably, the elastic member is made from a woven elastic, preferably polyester woven elastic. Preferably, the elastic member is stretchable to at least 40% of its original length, more preferably at least 60% of its original length, more preferably still at least 80% of its original length, more preferably still at least 100% of its original length.

Preferably, the elastic member has an equivalent spring constant of less than 500 N/m. That is to say, the elastic member extends by at least 1 cm under a load of 5 N, the elastic member having an original length of 13 cm. More preferably, the elastic member has a spring constant of between 100 N/m and 500 N/m.

Preferably, the elastic member is resilient. Thus, the elastic member, once stretched, acts like a spring to spring back to its unstretched state. For example, the material may have a modulus of resilience of greater than 0.7 Mpa, more preferably greater than 1.4 MPa, more preferably greater than 2.1 MPa.

Preferably, the elastic member between the portions, or the connecting means, or both, can pass from one wing to the other away from the bridging section, preferably at the tips of the wings.

Preferably, the user can make the connection between the portions of the elastic member and a wing or the bridging section by way of a fastener. Preferably, the user can disconnect the portions of the elastic member from a wing or the bridging section by way of a fastener.

Preferably, when the portions of the elastic member are (or are not) connected to a wing or the bridging section by the connecting means, at least a part of the elastic member is provided within a wing or the bridging section or both. The elastic member may be so provided when it is in a stretched or unstretched state.

This provides the advantage that the elastic member and possibly the connecting means can retract into the wing or bridging section, as the case may be, once tension has been removed from the elastic member.

At least a part of the elastic member that is so provided within a wing or the bridging section or both may be provided within a sleeve, for example a polyester sleeve. Preferably, the sleeve provides two layers of a sandwich structure with the elastic member between the two layers. The sleeve allows the elastic member to slide easily back and forth because of low friction between the elastic member and sleeve. Polyester is particularly suitable for this.

Alternatively, polyester material may be provided only on one side of the elastic member, for example on the inside of the elastic member, or on the outside of the elastic member, with respect to the space between the wings that is adjacent to the bridging section.

Advantageously, at least a part of the elastic member is provided within a wing or the bridging section or both so that the elastic member can slide within a wing or the bridging section or both. The sliding arrangement provides a convenient use of space.

Preferably, when the portions of the elastic member are (or are not) connected to a wing or the bridging section by the connecting means, the whole of the elastic member is provided within a wing or the bridging section or both. This may be the case when the elastic member is in a stretched or unstretched state.

Preferably, the pillow comprises a stop to prevent any portion of the elastic member leaving a wing or the bridging section, for example due to urging of the connecting means by the user. Thus, whether in a stretched or unstretched state, the whole of the elastic member is retained in a wing or the bridging section or both. This can prevent damage to the elastic member and also keeps the elastic member, which may be unsightly, hidden.

Advantageously, the whole of the elastic member is provided within a wing or the bridging section or both so that the elastic member can slide within a wing or the bridging section or both. The sliding arrangement provides a convenient use of space.

Advantageously, the elastic member comprises or is a strap. For the avoidance of doubt, the preferable features herein described with reference to the elastic member are equally applicable to the strap of the elastic member.

Preferably, when the portions of the elastic member are connected to a wing or the bridging section by the connecting means, at least a part of the strap of the elastic member is provided within a wing or the bridging section or both.

Preferably, when the portions of the elastic member are (or are not) connected to a wing or the bridging section by the connecting means, the whole of the strap of the elastic member is provided within a wing or the bridging section or both. This may be the case when the elastic member is in a stretched or unstretched state, for example when urged by a user or not urged by a user, or when the portions of the elastic member are connected to a wing or the bridging section by the connecting means, or conversely when the portions are disconnected.

Preferably, when the portions of the elastic member are (or are not) connected to a wing or the bridging section by the connecting means, at least a portion of the connecting means is provided within a wing or the bridging section or both. This may be the case when the elastic member is in a stretched or unstretched state, for example when urged by a user or when not urged by a user, or when the portions of the elastic member are connected to a wing or the bridging section by the connecting means, or conversely when the portions are disconnected.

At least a portion of the connecting means that is so provided within a wing or the bridging section or both may be provided within a sleeve, for example a polyester sleeve. Preferably, the sleeve provides two layers of a sandwich structure with the connecting means between the two layers. The sleeve allows the connecting means to slide easily back and forth because of low friction between the connecting means and sleeve. Polyester is particularly suitable for this.

Alternatively, polyester material may be provided only on one side of the connecting means, for example on the inside of the connecting means, or on the outside of the connecting means, with respect to the space between the wings that is adjacent to the bridging section.

Preferably, the connecting means comprises a strap. For the avoidance of doubt, the preferable features herein described with reference to the connecting means are equally applicable to the strap of the connecting means.

Preferably, when the portions of the elastic member are connected to a wing or the bridging section by the connecting means, at least a part, more preferably the whole, of the strap of the connecting means is provided within a wing or the bridging section or both.

Preferably, the elastic member, the connecting means or the strap of the connecting means comprises at least two parts which can be disconnected from one another. For example, the parts can be disconnected by means of a fastener such as a hook-and-loop arrangement, or a clip, buckle or toggle fastener or the like. Thus, if the elastic member does not stretch sufficiently to allow the wings to splay while the pillow is wrapped around the user's neck, the parts can be disconnected to allow the wings to splay further.

The elastic member may be disconnectable from the connecting means.

Preferably, the elastic member is provided adjacent to a fixing point. This means that, when at least a portion of the elastic member is within a wing or bridging section in the unstretched state, a longer elastic member can be used without being exposed than when the elastic member is provided away from the fixing point.

Preferably, the connecting means comprises an additional elastic member. For the avoidance of doubt, the preferable features herein described with reference to the elastic member referred to hereinbefore are equally applicable to additional elastic member.

Preferably, the fixing points are at different points on a wing or the bridging section, and the pillow comprises a reinforcing member or a gripping member that is fixed to a wing or the bridging section at the fixing points. However, the fixing points may be at the same point on a wing or the bridging section. The reinforcing member provides stable fixing points to which the elastic member can be connected.

The reinforcing member may also increase the resistance to bending of a wing or the bridging section: the resistance to bending of the wing or the bridging section to which the reinforcing member is fixed is greater than without the reinforcing member.

Preferably, the reinforcing member is rigid. That is to say, the resistance to bending of the reinforcing member in a direction that moves the wings towards or away from each other is greater than that of the bridging section. Preferably, the reinforcing member is substantially inextensible. Preferably, the reinforcing member comprises elastomeric material, more preferably a thermoplastic elastomer. Preferably, the reinforcing member is elongate.

Preferably, the reinforcing member is made from a material having a low extension stiffness. For example, the material may have a Young's modulus of less than or equal to 0.1 GPa, more preferably, less than or equal to 0.05 GPa, more preferably, less than or equal to 0.01 GPa, at small strains.

Preferably, the reinforcing member is resilient. This means that when the pillow is deformed for example by moving the wings towards or away from each other, the reinforcing member tends to return the wings to the position before deformation occurred. Preferably, the fixing points are different, i.e. the connecting means is fixed at different points. Preferably, the fixing points are both on the bridging section. Preferably, a fixing point is adjacent to a wing. Preferably, each fixing point is adjacent to a respective wing. Preferably, the fixing points are adjacent to the reinforcing member.

Preferably, the substantially U-shaped shape is formed in plan view, and the bridging section has an outer peripheral surface in plan view, and the reinforcing member is provided on the outer peripheral surface of the bridging section. "Outer" here means outer with respect to the centre of the substantially U-shaped shape in plan view.

Preferably, the reinforcing member is fixed to the bridging section and provided along the outer peripheral surface of the bridging section, to restrain deformation of the bridging section. For example, the reinforcing member may be provided on or below the outer peripheral surface, and the reinforcing member may or may not contact the peripheral surface.

Preferably, the pillow comprises a stop for limiting movement, for example stretching, of the elastic member or connecting means. Two stops may be provided, one for limiting movement of the elastic member, and the other for limiting movement of the connecting means.

Preferably, the movement is due to urging by the elastic member, for example when the elastic member tends to return to its unstretched state. The stop may, for example, prevent an end of the elastic member being retracting into a wing or the bridging section.

Alternatively, the movement may be due to urging by the user, for example when the user pulls the connecting means. Hence the stop can, for example, prevent the elastic member being stretched past its elastic limit.

The stop may be provided at the point that the elastic member or connecting means can pass out of a wing or the bridging section. The stop may be adapted to catch a holding portion of the connecting means or elastic member, for example an end.

Preferably, the stop comprises a gate adapted to catch a holding portion of the connecting means or elastic member. The gate may be provided to allow the connecting means to pass out of a wing or the bridging section. Preferably, the gate is adapted to catch the holding portion once the whole of a strap of the connecting means is within a wing or the bridging section. Preferably, the whole of the elastic member is also within a wing or the bridging section.

Preferably, the gate is adapted to catch the holding portion when the whole of a strap of the connecting means has passed out of a wing or the bridging section.

Preferably, a buckle is provided to allow parts of the connecting means or elastic member to be disconnected, and preferably the buckle provides the holding portion.

Preferably, the connecting means or elastic member comprises a strap, and the holding portion is at one end of the strap. Thus the holding portion can be caught once the strap has been fully retracted.

Preferably, when the holding portion is caught in the gate thereby limiting movement of the elastic member or connecting means due to urging by the elastic member, the elastic member continues to urge the holding portion towards the gate. In this case, the elastic remains under tension. This arrangement ensures that any portion of the elastic member or connecting means that has already been retracted remains fully retracted.

Preferably, the substantially U-shaped shape is formed in plan view, and each of the wings has an outer peripheral side surface in plan view, and, when the portions of the elastic member are connected to a wing or the bridging section by the connecting means, at least a part of the elastic member or connecting means is provided adjacent to, for example on or below, the outer peripheral side surface of a wing. The effect of providing at least a portion of the elastic member or connecting means adjacent to the outer peripheral side surface of a wing is as follows. There is friction between the elastic member or connecting means and the wing when the elastic member is connected to a wing or the bridging section by the connecting means. This friction opposes the elastic force of the elastic member. This means that, after the wings have been pulled apart by the user, the friction restrains the restoring force in the elastic member from pulling the wings together. Therefore, the relative position of the wings can, to a certain extent, be adjusted simply by pulling them apart.

Preferably, the at least a portion of the elastic member or connecting means that is adjacent to the outer peripheral side surface of a wing is provided adjacent the bridging section, and preferably at the midpoint between bridging section and wing tip. Preferably, the at least a portion is provided at the midpoint between the top surface and bottom surface of the wing in elevation view. Preferably, the at least a portion runs along the peripheral side surface at the midpoint between the top surface and bottom surface. Preferably, the elastic member or connecting means runs around a wing tip when the elastic member is connected to a wing or the bridging section by the connecting means.

Preferably, the substantially U-shaped shape is formed in plan view, and the bridging section has an outer peripheral surface in plan view, and, when the portions of the elastic member are connected to a wing or the bridging section by the connecting means, at least a part of the elastic member or connecting means is provided adjacent to, for example on or below, the outer peripheral surface of the bridging section.

Preferably, the surface of a wing or the bridging section comprises a layer of fabric. Preferably, a wing or the bridging section has a filling of foam, advantageously memory foam. Preferably, the wings and bridging section are filled with a single piece of memory foam.

Preferably, the elastic member or connecting means is provided below a layer of fabric forming the surface of a wing or the bridging section. Preferably, the elastic member or connecting means is provided between two layers of fabric forming the surface of a wing or the bridging section. The two layers of fabric may provide a slot in which the elastic member or connecting means can slide.

Preferably, when the wings and bridging section form a substantially U-shaped shape in plan view, the thickness of the thinnest portion of the bridging section is less than the thickness of the thickest portion of the wings, and preferably less than the thinnest portion of the wings. This arrangement prevents the head of the user being pushed too far away from the surface on which the pillow is placed.

A second aspect of the present invention provides a pillow comprising two wings; a bridging section connecting the wings so that the wings and bridging section form a substantially U-shaped shape in plan view, and the bridging section has an outer peripheral surface in plan view; and a rigid reinforcing member fixed to the bridging section and provided along, on or adjacent to the outer peripheral surface of the bridging section, to limit deformation of the bridging section. The reinforcing member strengthens the bridging section against deformation, for example twisting or bending. The bridging section may be prone to excessive bending or twisting if it is relatively thin in plan view in comparison to the wings.

By "rigid" it is meant that the resistance to bending of the reinforcing member in a direction that moves the wings towards or away from each other is greater than that of the bridging section. By providing that the reinforcing member is rigid, an equivalent thicker section of the bridging section can be dispensed with, and the total thickness of the bridging section and reinforcing member can be kept down.

For example, the reinforcing member may be provided on or below the outer peripheral surface, and the reinforcing member may or may not contact the peripheral surface.

Preferably, the wings are fixed to one side of the bridging section, and the reinforcing member is fixed to the opposite side of the bridging section at least at portions that are opposite to portions of the bridging section to which the wings are fixed. This means that the reinforcing member provides significant strengthening against bending so as to prevent the wings moving too far apart.

Preferably, the wings are fixed to one side of the bridging section, and the reinforcing member is fixed to the opposite side of the bridging section between portions that are opposite to portions of the bridging section to which the wings are fixed. This provides additional strengthening.

Preferably, the reinforcing member is fixed to the bridging section along the outer peripheral surface.

Preferably, the reinforcing member comprises elastomeric material, more preferably a thermoplastic elastomer.

Preferably, the reinforcing member is resilient. This means that when the pillow is deformed for example by moving the wings towards or away from each other, the reinforcing member tends to return the wings to the position before deformation occurred.

Preferably, the reinforcing member is elongate. Preferably, the reinforcing member is provided so that its longer dimension runs in a direction from one wing to the other.

Preferably, the reinforcing member comprises at least one ridge. The ridge increases the reinforcing effect of the reinforcing member.

Preferably, the at least one ridge runs in a direction from one wing to the other. This increases resistance to bending so as to prevent the wings moving too far apart. Preferably, the at least one ridge runs in a direction from the top surface of the bridging section in elevation view to the bottom surface of the bridging section in elevation view. Preferably, the at least one ridge runs in both directions.

Preferably, the at least one ridge is provided on the outer peripheral surface of the reinforcing member.

A third aspect of the present invention provides a pillow comprising two wings; a bridging section connecting the wings so that the wings and bridging section form a substantially U-shaped shape in plan view, and the bridging section has an outer peripheral surface in plan view; and a gripping member provided on and fixed to the outer peripheral surface of the bridging section, to improve grip between the bridging section and a surface which the bridging section contacts.

The gripping member improves grip between the bridging section and a surface, for example the surface of a chair, which the bridging section contacts. The bridging section of a typical U-shaped pillow is made of a smooth fabric, and the surface of a chair which the bridging section contacts may also be made of a smooth fabric. The improved grip helps prevent the pillow rotating around the user's neck when in use. By doing so the gripping member helps to keep the pillow in the intended position holding the head and neck in the upright position and provides a continuous level of support even if the user shifts in a seat during use.

A test for whether the gripping member provides sufficient grip is proposed as follows. The pillow is placed upright on a sheet of A4 photocopier paper, with the whole of the gripping member contacting the sheet of paper and the wings extending upwards. One of the wings is then pushed sideways at a point adjacent to its wing tip, in a direction from one wing to another. If the pillow rolls, i.e. one end of the bridging section lifts off the paper, then the gripping member provides sufficient grip. If, however, the pillow slides along the paper then the gripping member does not provide sufficient grip.

Preferably, the gripping member is provided along the outer peripheral surface of the bridging section.

Preferably, the wings are fixed to one side of the bridging section, and the gripping member is fixed to the opposite side of the bridging section at least at portions that are opposite to portions of the bridging section to which the wings are fixed.

Preferably, the wings are fixed to one side of the bridging section, and the gripping member is fixed to the opposite side of the bridging section between portions that are opposite to portions of the bridging section to which the wings are fixed.

Preferably, the gripping member is fixed to the bridging section along the outer peripheral surface.

Preferably, the gripping member is rigid. That is to say, the resistance to bending of the gripping member in a direction that moves the wings towards or away from each other is greater than that of the bridging section.

Preferably, the gripping member is resilient. This means that when the pillow is deformed for example by moving the wings towards or away from each other, the gripping member tends to return the wings to the position before deformation occurred. Preferably, the coefficient of friction between the gripping member and photocopier paper is about 0.7. Part of the outer surface the wings and bridging section may be provided by a felt material, and the coefficient of friction between the felt material and photocopier paper is preferably about 0.4. Hence the gripping member improves grip when compared to the felt material.

Preferably, the gripping member comprises elastomeric material, more preferably a thermoplastic elastomer.

Preferably, the gripping member is elongate. Preferably, the gripping member is provided so that its longer dimension runs in a direction from one wing to the other.

Preferably, the gripping member comprises at least one ridge. The ridge increases the gripping effect of the gripping member.

Preferably, the at least one ridge runs in a direction from one wing to the other. This increases gripping effect so as to resist sliding in a direction parallel with the user's neck. Preferably, the at least one ridge runs in a direction from the top surface of the bridging section in elevation view to the bottom surface of the bridging section in elevation view. Preferably, the at least one ridge runs in both directions.

Preferably, the at least one ridge is provided on the outer peripheral surface of the gripping member.

The preferable features herein described with reference to first aspect of the invention are equally applicable to the second or third aspects of the invention, and vice versa.

BRIEF DESCRIPTION OF THE DRAWINGS

A preferred embodiment of the invention will now be described, purely by way of example, with reference to the drawings in which.

DETAILED DESCRIPTION OF THE PREFERRED EMBODIMENTS

Figure 1:
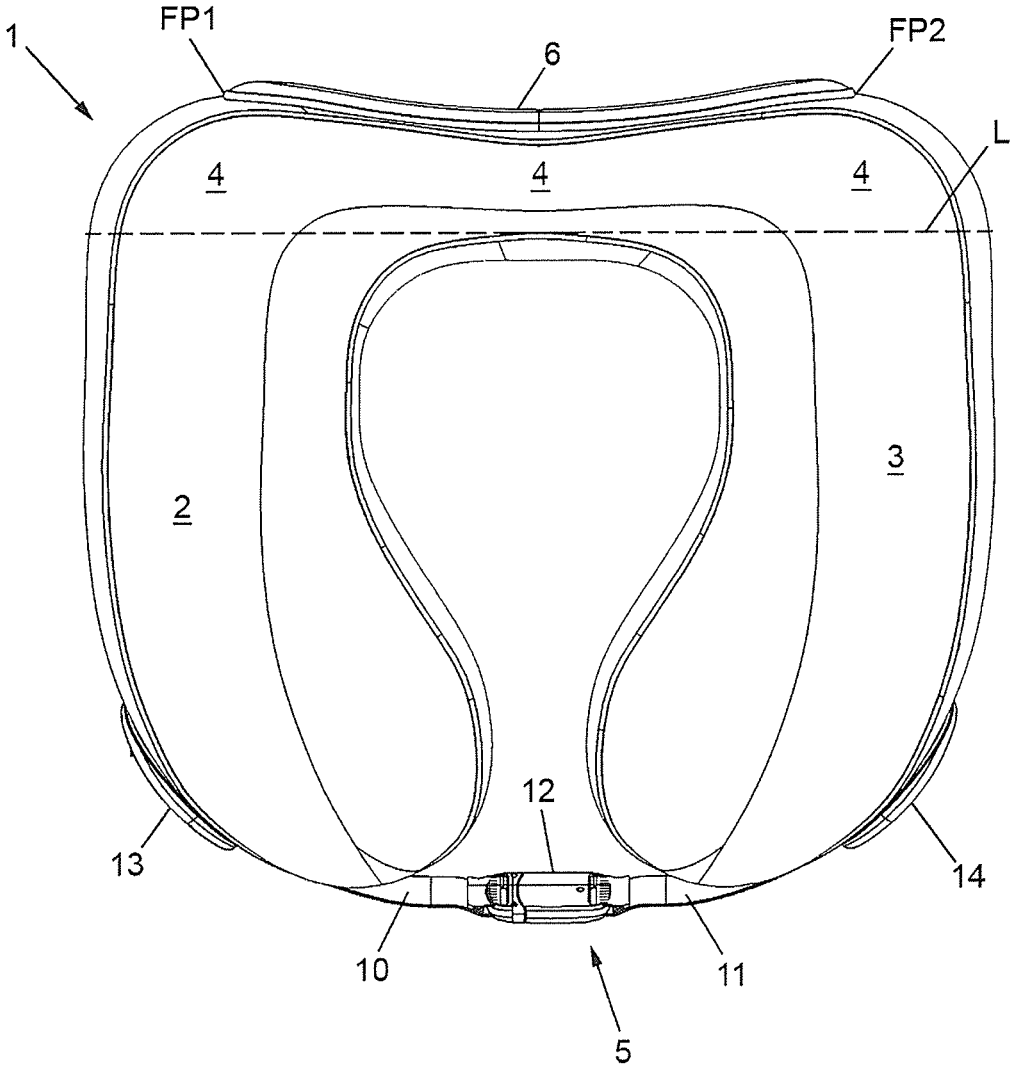
FIG. 1 is a top plan view of a pillow according to the preferred embodiment of the invention.
Figure 2:
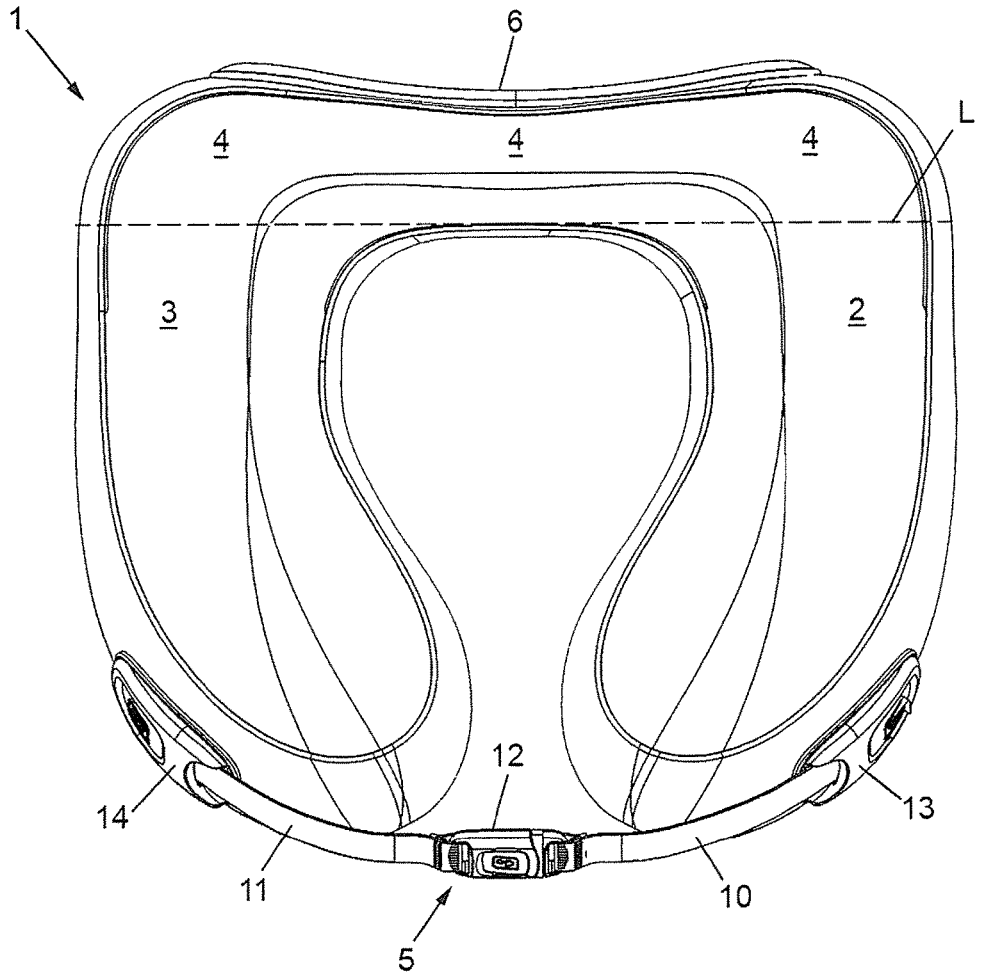
FIG. 2 is a bottom plan view of the pillow of FIG. 1.

Referring to FIG. 1, according to a preferred embodiment of the invention, a pillow 1 comprises two wings 2, 3 and a bridging section 4 connecting the wings 2, 3 so that the wings 2, 3 and bridging section 4 form a substantially U-shaped shape. The pillow 1 also comprises a first elastic member, which is not shown in FIG. 1. In the preferred embodiment, the whole of the first elastic member is at all times provided within the wing 2 and the bridging section 4. The pillow 1 further comprises connecting means 5 which connect one portion of the first elastic member to a first fixing point FP1 on the bridging section 4 and another portion of the first elastic member to a second fixing point FP2 on the bridging section 4, so that the connecting means 5 can pass from wing 2 to wing 3 and the first elastic member can urge the wings towards one another.

In the figures, the wings 2, 3 are divided from the bridging section 4 by line L.

In this embodiment the pillow is shown ready for use in that the connecting means 5 is shown already connecting one portion of the first elastic member to the first fixing point FP1 and another portion of the first elastic member to the second fixing point FP2.

In the present embodiment, the first elastic member is provided adjacent the first fixing point FP1.

The connecting means 5 comprises a first strap 10, a buckle 12, a second strap 11 and a second elastic member. The second elastic member is not shown in FIG. 1. In the preferred embodiment, the whole of the second elastic member is at all times provided within the wing 3 and the bridging section 4.

The first and second straps 10 and 11 are made of polyester. The dimensions of each of the first and second straps 10, 11 are approximately as follows: total length is 160 mm; width is 19 mm; thickness is 1 mm.

In the present embodiment, the first elastic member and second elastic member are provided within respective polyester sleeves. One sleeve is provided on the outside of the wing 2 and bridging section 4, and the other sleeve is provided on the outside of the wing 3 and bridging section 4. The sleeves allow the elastic members to slide easily within them.

In the present embodiment, the first and second elastic members are respective straps.

The connecting means 5 further comprises stitching which connects one end of the first elastic member to the bridging section 4 at the first fixing point FP1, and stitching which connects one end of the second elastic member to the bridging section 4 at the second fixing point FP2.

The other end of the first elastic member is fixed to one end of the first strap 10. The other end of the first strap 10 is fixed to one end of the buckle 12. The other end of the buckle 12 is fixed to one end of the second strap 11. The other end of the second strap 11 is fixed to one end of the second elastic member, which is the end that is not connected to the second fixing point FP2 by stitching.

The buckle 12 has two parts, namely a male part and a female part. The male part is fixed to the first strap 10 and the female part is fixed to second strap 11.

In FIG. 1 the pillow is shown in the "in use" position, that is to say the position it would take when being used and when wrapped around the neck of the user. The user's neck prevents the tips of the wings 2, 3 from touching. The male part of buckle 12 is snap-fitted into the female part to fasten the respective ends of the straps 10, 11 together. In this state, the first and second elastic members have been stretched from their unstretched position and are in their stretched position. The tension in the first and second elastic members urges the wings 2, 3 towards one another. When the pillow 1 is not wrapped around the user's neck but the buckle 12 is fastened, the tips of the wings 2, 3 may touch due to urging by the first and second elastic members.

Gates 13, 14 are provided on wings 2, 3, respectively. The gates 13, 14 are provided to allow the first and second straps 10, 11, respectively, to pass out of the first and second wings, 2, 3, respectively. The gates 13, 14 are made of rubber.

As shown in FIG. 1, which is a plan view, the substantially U-shaped shape is formed in plan view. The bridging section 4 has an outer peripheral surface, which is outer with respect to the centre of the substantially U-shaped shape in plan view. The bridging section 4 also has an inner peripheral surface, which is inner with respect to the centre of the substantially U-shaped shape in plan view.

A rigid reinforcing and gripping member in the form of a plate 6 is provided on, along and fixed to the outer peripheral surface of the bridging section 4. The plate 6 is rigid, which is to say the resistance to bending of the plate 6 in a direction that moves the wings 2, 3 towards or away from each other is greater than that of the bridging section 4. The plate 6 is fixed to the bridging section 4 at the first and second fixing points FP1 and FP2. The stitching that connects the first and second elastic members to the first and second fixing points FP1 and FP2 also fixes the plate 6 to the first and second fixing points FP1 and FP2. The fixing points FP1 and FP2 are opposite to portions of the bridging section 4 to which wings 2, 3 are connected.

The deflection of the wings 2, 3 of the pillow 1 of the present embodiment was measured to determine the effect of the plate 6. In particular, with only one end of the plate 6 held and the wings 2, 3 pointing upwards and buckle 12 unfastened, the other end of plate 6 was found to deflect by about 4 cm due to self-weight of the pillow 1. In contrast, when the memory foam filling of the pillow 1 was removed, the corresponding deflection was found to be about 12 cm due to self-weight of the filling.

The plate 6 performs several functions: firstly, the plate 6 provides grip between the bridging section 6 and a surface which the bridging section 6 contacts; secondly, the plate 6 limits deformation of the bridging section; and thirdly, the plate 6 provides stable fixing points to which the first and second elastic members can be connected. The plate 6 is formed of an elastomeric material, namely a thermoplastic elastomer (TPE). A suitable TPE material can be obtained from AIFFU International Limited of Wan Chai, Hong Kong. The coefficient of friction between the plate 6 and photocopier paper is about 0.7.

The plate 6 in the present embodiment is about 205 mm long at it longest point, 40 mm wide, and 8 mm thick at its thickest point.

The surface of the wings 2, 3 and bridging section 4 comprises a layer of flexible fabric forming a jacket. The wings 2, 3 and bridging section 4 are filled with a single piece of memory foam. Stable fixing points are necessary so that the elastic members urge the wings towards one another. Without the plate 6, the elastic members would be fixed only to the flexible fabric jacket, which alone would not provide stable fixing points.

In the position shown in FIG. 1, the first and second elastic members and a portion of each of first and second straps 10, 11 are provided between two layers of fabric forming the surface of wings 2, 3, respectively, and between two layers of fabric forming the surface of the bridging section 4. The two layers of fabric provide respective slots in which the elastic members and the first and second straps 10, 11 can slide.

Referring to FIG. 1, the thickness of the thinnest portion of the bridging section 4, which is at its midpoint, is less than the thickness of the thickest portion of the wings 2, 3, and less than the thinnest portion of the wings 2, 3. The tips of the wings 2, 3 are bulbous.

The wings 2, 3 and bridging section 4 are symmetrical in plan view about a line passing between the tips of wings 2, 3 and through the midpoint of the bridging section 4. The plate 6 is symmetrical in plan view about the same line, as are the fixing points FP1, FP2. In the present embodiment, the plate 6 and the fixing points FP1, FP2 are on the rear surface of the bridging section 4. The rear surface faces in a rear direction, away from the tips of the wings 2, 3.

Figure 3:
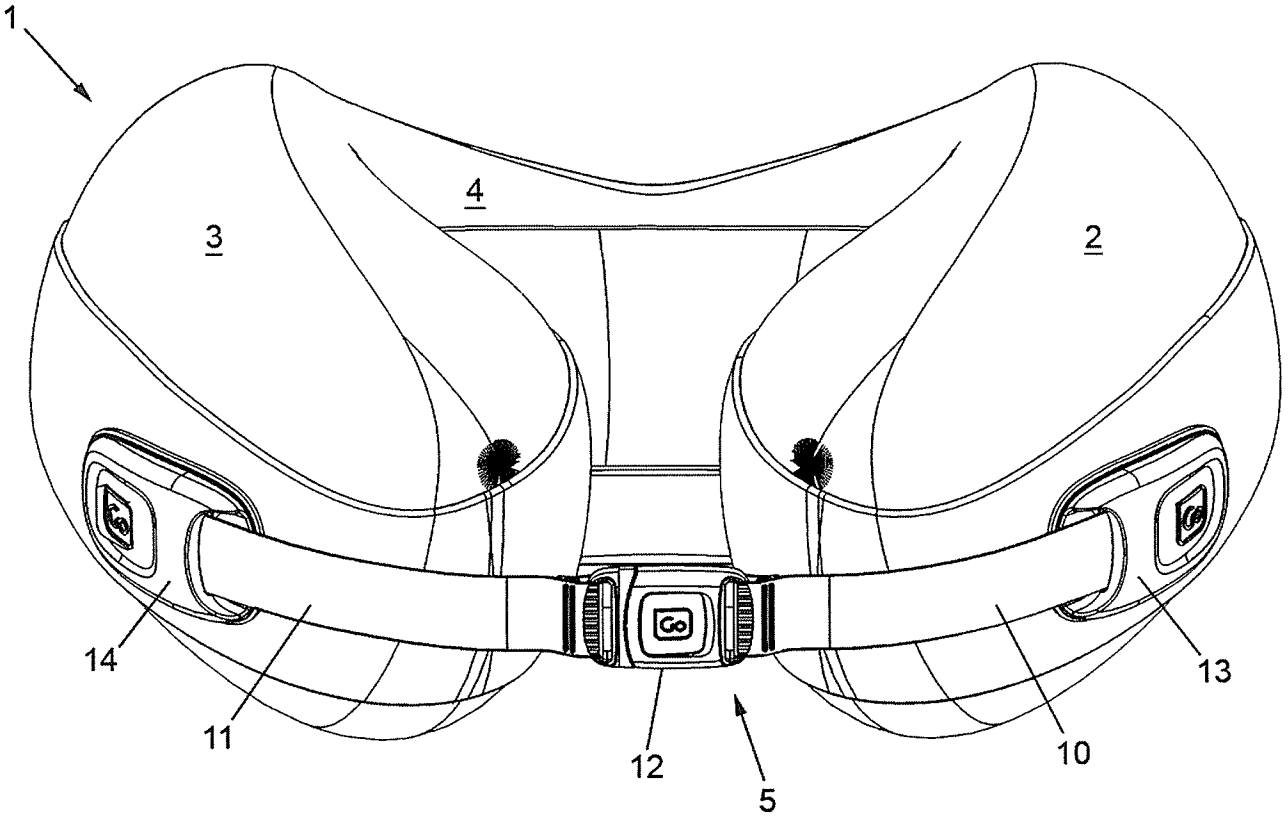
FIG. 3 is a front elevation view of the pillow of FIG. 1.

As shown in FIG. 3, the top surface of the bridging section 4 forms a V-shape in elevation view.

Figure 5:
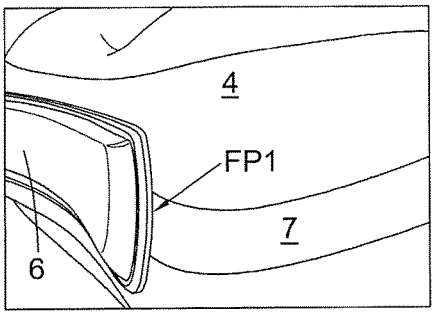
FIG. 5 is fragmentary oblique view of the rear and side of the pillow of FIG. 1.

FIG. 5 shows the detail of one end of the first elastic member 7 through the fabric jacket and the detail of one end of the plate 6. One end of the first elastic member 7 is connected to one end of the plate 6 at the first fixing point FP1 on the outer peripheral surface of the bridging section 4. Strong stitching connects the first elastic member 7 and the plate 6 at the first fixing point FP1. One end of the second elastic member 8 is connected to the other end of plate 6 at the second fixing point FP2 in a corresponding manner.

In the present embodiment, the dimensions of each of the first and second elastic members 7, 8 in their unstretched state are approximately as follows: total length is 170 mm; width is 26 mm; thickness is 1.35 mm. As referred to above, each elastic member 7, 8 has stitching at both of its ends. The length between the stitching at each end of the elastic member 7 is about 130 mm, and so this is the length that can stretch.

In the present embodiment, the elastic member is made from polyester woven elastic. A suitable polyester woven elastic material can be obtained from Tianao Holdings Limited of Kowloon, Hong Kong. In the present embodiment, the polyester woven elastic is 75% polyester and 25% rubber.

Figure 6:
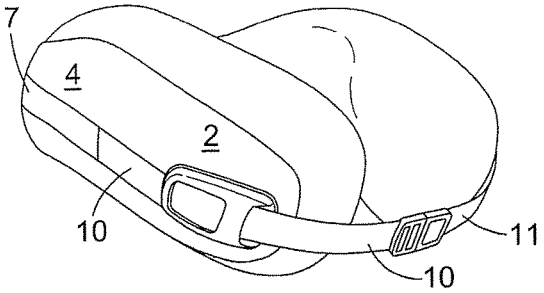
FIG. 6 is an isometric view of the pillow of FIG. 1.

FIG. 6 shows the other end of the first elastic member 7 which is fixed to one end of the strap 10. When the pillow is in the in use position, the first elastic member 7 passes from the bridging section 4 to the wing 7. The elastic member passes along the outer peripheral surface of the bridging section from the first fixing point FP1 to the outer peripheral side surface of the wing 2 to the position where it is fixed to the strap 10. From this point the strap 10 passes along the outer peripheral side surface of the wing 2 to the outer peripheral tip surface of the wing 2. The strap 10 then leaves the surface of the wing 2 and passes towards the wing 3 until it reaches the buckle 10. The second elastic member 8 and the strap 11 are provided on the bridging section 4 and wing 3 in a corresponding manner.

Once the buckle 12 has been unfastened and the tension in the first elastic member 7 has moved the elastic member 7 to the unstretched position, the whole of the elastic member 7 is provided within the bridging section 4. However, depending on the length of the elastic member 7, the whole of the elastic member 7 may be provided within both the bridging section 4 and wing 2 in the unstretched position. In the stretched position, however, the whole of the elastic member 7 is provided within both the bridging section 4 and wing 2. The same is true for the second elastic member 8, mutatis mutandis.

Referring to FIGS. 1 to 8, gates 13, 14 are each adapted to catch a holding portion of the connecting means 5, in the present embodiment the male and female parts of the buckle 12, respectively.

Figure 7:
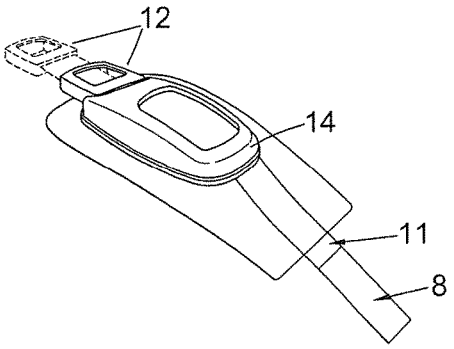
FIG. 7 is a fragmentary isometric view of a gate, elastic member and connecting means of the pillow of FIG. 1.
Figure 8:
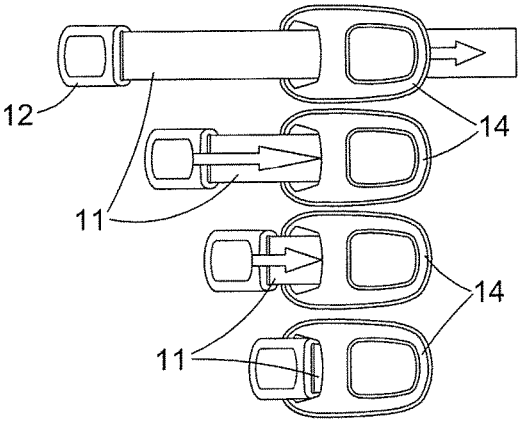
FIG. 8 is a fragmentary elevation view of a gate and connecting means of the pillow of FIG. 1.

As shown in FIGS. 7 and 8 for the gate 14, the strap 11 is retracted by the second elastic member 8 and the female part of buckle 12 is caught in gate 14 once the whole of strap 11 has been retracted. The male part of buckle 12 is caught in gate 13 in a corresponding manner. FIG. 7 shows the two different positions of the female part of buckle 12. FIG. 8 shows different stages as the strap 11 is retracted, and shows the different positions of the female part of buckle 12. In the top three stages, the arrow shows the direction of retraction.

Once the whole of each first and second strap 10, 11 has been retracted into the wings 2, 3, respectively, the male and female parts of the buckle 12 can be grasped and pulled by the user to pull the straps 10 and 11 out of the wings 2, 3 thereby stretching the first and second elastic members 7, 8.

When the male and female parts of the buckle 12 are caught in the gates 13, 14, the elastic members 7, 8 continue to urge the male and female parts of the buckle 12 towards the gates 13, 14. In that case, the elastic remains under tension. This arrangement ensures that any portion of the elastic member 7, 8 or connecting means 5 that has already been retracted remains fully retracted.

The gates 13, 14 are also each adapted to catch a holding portion of the connecting means 5 when the whole of each of the first and second straps 10, 11 has passed out of a wings 2, 3, respectively. In the present embodiment, only part of each of the straps 10, 11 have passed out of the wings 2, 3 when the pillow is in the in use position. In the present embodiment, these holding portions are provided at the join between the first elastic member 7 and the first strap 10, and at the join between the second elastic member 8 and the second strap 11. Thus the gates 13, 14 prevent any part of the elastic members leaving the wings 2, 3.

Figure 9:
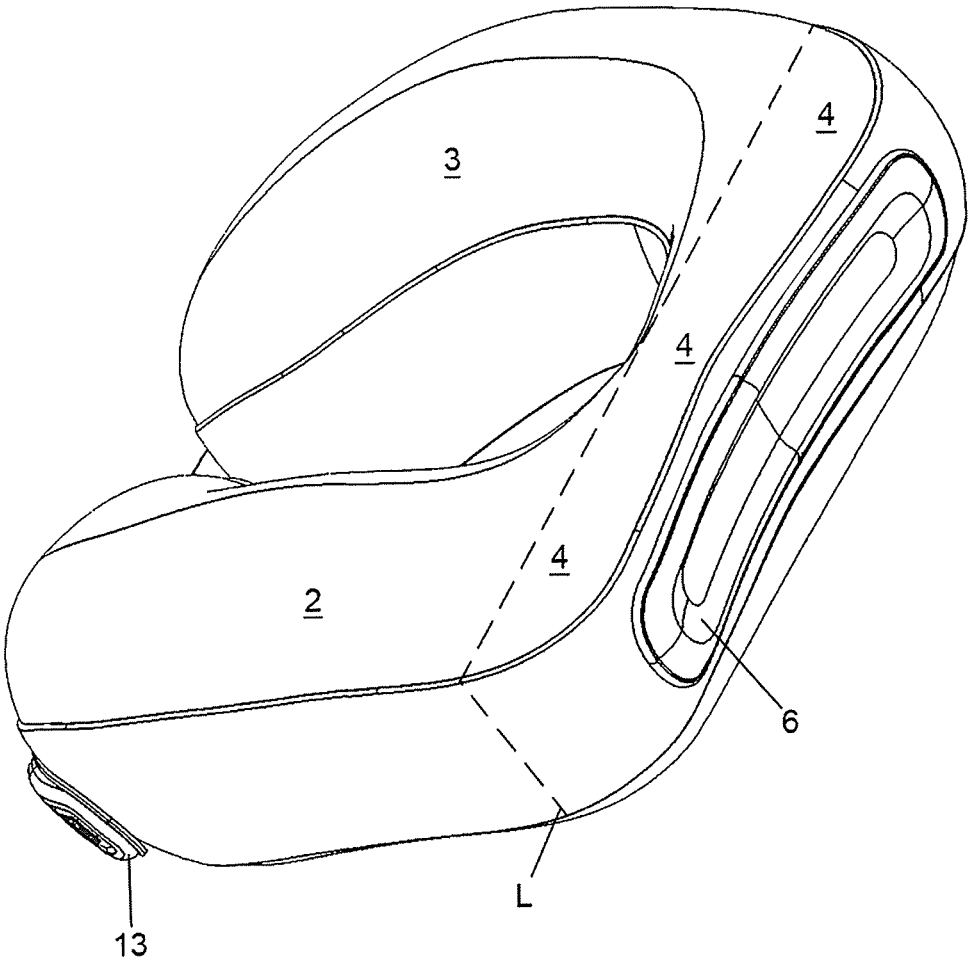
FIG. 9 is an isometric view of the rear and side of the pillow of FIG. 1.
Figure 10:
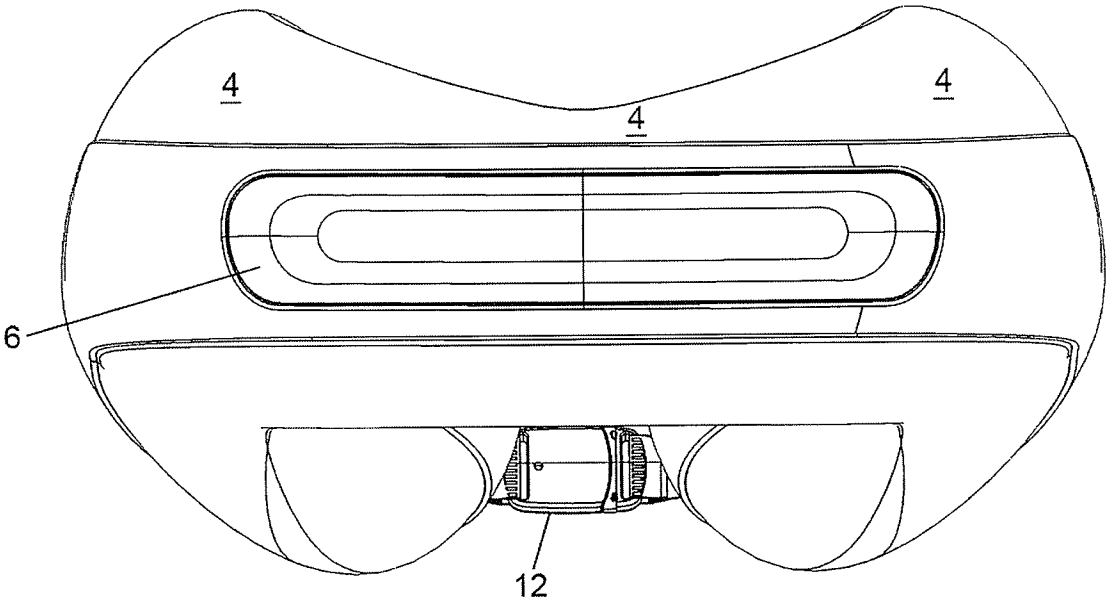
FIG. 10 is a rear elevation view of the pillow of FIG. 1.

FIGS. 9 and 10 show plate 6 on the rear surface of the bridging section 4. The rear surface faces in a rear direction, away from the tips of the wings 2, 3. The whole of one surface of the plate 6 contacts the rear surface of the bridging section 4. This surface of the plate 6 is fixed around its periphery to the rear surface of the bridging section 4 by stitching.

When the pillow is in the in use position but not wrapped around the neck of a user, the surface of the plate 6 fixed to the rear surface of the bridging section 4 is substantially planar. When the pillow is not in the in use position and the straps 10, 11 are fully retracted, the surface of the plate 6 fixed to the rear surface of the bridging section 4 has a slightly bowed shape with the ends of the surface more rearward than the midpoint of the surface.

The plate 6 has a peripheral ridge on its rear surface (that is the outer peripheral surface of the plate 6, which is the surface opposite to the surface fixed to the bridging section 4). The peripheral ridge is provided around the periphery of the rear surface of the plate 6. The peripheral ridge comprises two straight long ridges running in a direction from wing 2 to wing 3, and two short curved ridges joining the two straight ridges at their ends. The peripheral ridge is about 2 mm high.

The plate 6 is elongate with its longer dimension running in a direction from wing 2 to wing 3. Plate 6 comprises rubber and is substantially inextensible. Plate 6 is also resilient which means that when the pillow 1 is deformed for example by moving the wings 2, 3 towards or away from each other, the plate 6 tends to return the wings 2, 3 to their position before deformation occurred.

Figure 4:
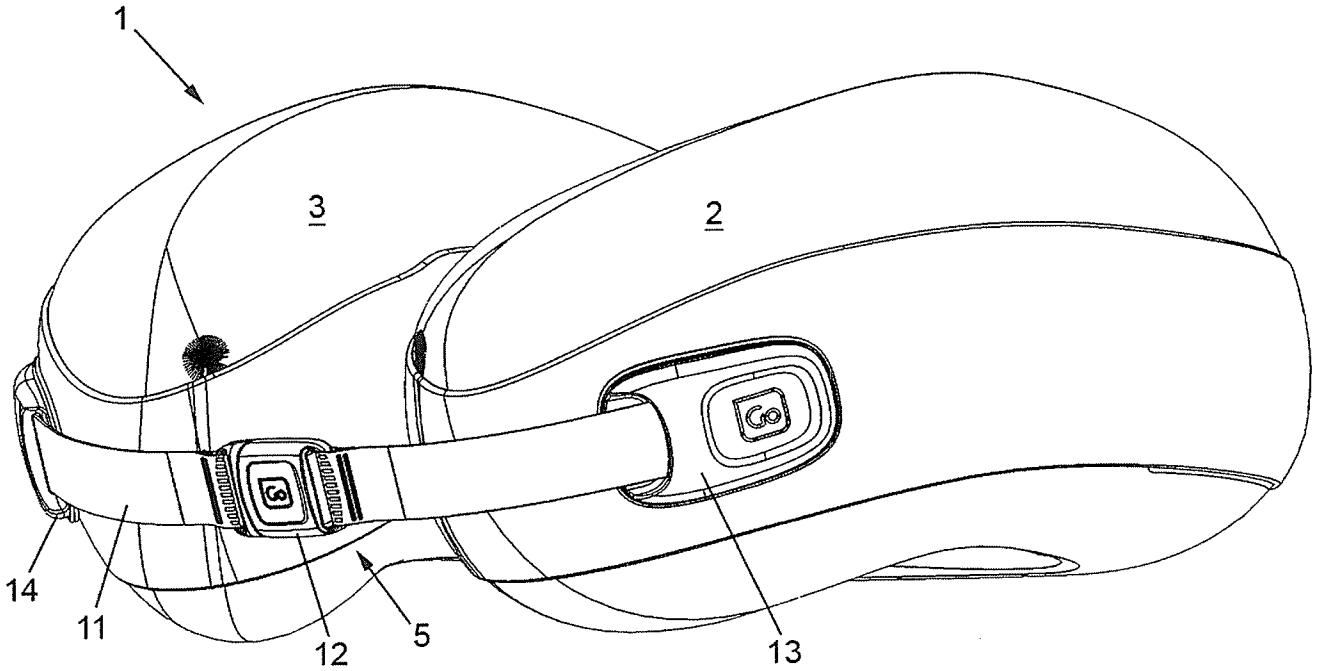
FIG. 4 is an oblique view of the front and side of the pillow of FIG. 1.

As can be seen most clearly from FIGS. 3, 4 and 10, the pillow 1 is not symmetrical about a "horizontal" plane, i.e. a plane that is normal to the direction of view in FIG. 1. For example, as shown in FIG. 4, the wings 2, 3 each curve upwards and then downwards as the wing extends from the bridging section 4 to the wing tip. In addition, as shown in FIG. 10, the top of the bridging section 4 curves downwards in the middle, but the bottom of the bridging section 4 is flat. This shaping makes the pillow more comfortable for the user as it fits the body more snuggly.

The preferred embodiment of the present invention has been described purely by way of example, and various modifications, additions and/or omissions will present themselves to one skilled in the art, all of which form part of the invention, together with their equivalents.

The invention claimed is:

1. A pillow comprising:

two wings;

a bridging section connecting the wings so that the wings and bridging section form a substantially U-shaped shape;

an elastic member; and connecting means for connecting one portion of the elastic member to a fixing point on a wing or the bridging section and another portion of the elastic member to a fixing point on a wing or the bridging section, so that the elastic member, or the connecting means, or both, can pass from one wing to the other and the elastic member can urge the wings towards one another, wherein, when the portions of the elastic member are connected to a wing or the bridging section by the connecting means, at least a part of the elastic member is provided within a wing or the bridging section or both so that the elastic member can slidably retract into a wing or the bridging section or both.

2. A pillow according to claim 1, wherein the substantially U-shaped shape is formed in plan view, and each of the wings has an outer peripheral side surface in plan view, and, when the portions of the elastic member are connected to a wing or the bridging section by the connecting means, at least a part of the elastic member or connecting means is provided adjacent to the outer peripheral side surface of a wing.

3. A pillow according to claim 1, wherein the substantially U-shaped shape is formed in plan view, and the bridging section has an outer peripheral surface in plan view, and, when the portions of the elastic member are connected to a wing or the bridging section by the connecting means, at least a part of the elastic member or connecting means is provided adjacent to the outer peripheral surface of the bridging section.

4. A pillow according to claim 1, wherein, when the portions of the elastic member are connected to a wing or the bridging section by the connecting means, the whole of the elastic member is provided within a wing or the bridging section or both.

5. A pillow according to claim 4, wherein the whole of the elastic member is provided within a wing or the bridging section or both so that the elastic member can slide within a wing or the bridging section or both.

6. A pillow according to claim 1, wherein the elastic member comprises a strap.

7. A pillow according to claim 6, wherein, when the portions of the elastic member are connected to a wing or the bridging section by the connecting means, at least a part of the strap of the elastic member is provided within a wing or the bridging section or both.

8. A pillow according to claim 6, wherein, when the portions of the elastic member are connected to a wing or the bridging section by the connecting means, the whole of the strap of the elastic member is provided within a wing or the bridging section or both.

9. A pillow according to claim 1, wherein the connecting means comprises a strap.

10. A pillow according to claim 9, wherein, when the portions of the elastic member are connected to a wing or the bridging section by the connecting means, at least a part of the strap of the connecting means is provided within a wing or the bridging section or both.

11. A pillow according to claim 9, wherein the strap of the connecting means comprises at least two parts which can be disconnected from one another.

12. A pillow according to claim 1, wherein the elastic member is provided adjacent to a fixing point.

13. A pillow according to claim 1, wherein the connecting means comprises an additional elastic member.

14. A pillow according to claim 1, wherein the fixing points are at different points on a wing or the bridging section, and the pillow comprises a reinforcing member that is fixed to a wing or the bridging section at the fixing points.

15. A pillow according to claim 14, wherein the fixing points are both on the bridging section.

16. A pillow according to claim 15, wherein the substantially U-shaped shape is formed in plan view, and the bridging section has an outer peripheral surface in plan view, and the reinforcing member is provided on the outer peripheral surface of the bridging section.

17. A pillow according to claim 1, comprising a stop for limiting movement of the elastic member or connecting means.

18. A pillow according to claim 17, wherein the movement is due to urging by the elastic member.

19. A pillow according to claim 17, wherein the movement is due to urging by the user.

20. A pillow according to claim 17, wherein the stop comprises a gate adapted to catch a holding portion of the connecting means or elastic member.

21. A pillow according to claim 20, wherein the connecting means or elastic member comprises a strap, and the holding portion is at one end of the strap.

22. A pillow according to claim 20, wherein, when the holding portion is caught in the gate thereby limiting movement of the elastic member or connecting means due to urging by the elastic member, the elastic member continues to urge the holding portion towards the gate.

23. A pillow comprising:

two wings;

a bridging section connecting the wings so that the wings and bridging section form a substantially U-shaped shape in plan view, and the bridging section has an outer peripheral surface in plan view; and a rigid reinforcing member fixed to the bridging section and provided along the outer peripheral surface of the bridging section, to limit deformation of the bridging section, wherein the reinforcing member has at least one rigid reinforcing ridge which is provided on the outer peripheral surface of the reinforcing member.

24. A pillow according to claim 23, wherein the reinforcing member is elongate.

25. A pillow according to claim 23, wherein the at least one ridge runs in a direction from one wing to the other.

26. A pillow according to claim 23, wherein the wings are fixed to one side of the bridging section, and the reinforcing member is fixed to the opposite side of the bridging section at least at portions that are opposite to portions of the bridging section to which the wings are fixed.

27. A pillow according to claim 23, wherein the wings are fixed to one side of the bridging section, and the reinforcing member is fixed to the opposite side of the bridging section between portions that are opposite to portions of the bridging section to which the wings are fixed.

28. A pillow according to claim 23, wherein the reinforcing member is fixed to the bridging section along the outer peripheral surface.

29. A pillow according to claim 23, wherein the reinforcing member is resilient.

30. A pillow according to claim 23, wherein the reinforcing member comprises elastomeric material.

31. A pillow comprising:

two wings;

a bridging section connecting the wings so that the wings and bridging section form a substantially U-shaped shape in plan view, and the bridging section has an outer peripheral surface in plan view; and a gripping member provided on and fixed to the outer peripheral surface of the bridging section, to improve grip between the bridging section and a surface which the bridging section contacts, wherein the gripping member has a gripping ridge which is provided on the outer peripheral surface of the gripping member, and wherein the ridge runs in a direction from one wing to the other and runs in a direction from the top surface of the bridging section in elevation view to the bottom surface of the bridging section in elevation view.

32. A pillow according to claim 31, wherein the gripping member is resilient.

33. A pillow according to claim 31, wherein the gripping member is rigid.

34. A pillow according to claim 31, wherein the gripping member comprises elastomeric material.

35. A pillow according to claim 31, wherein the gripping member is elongate.

36. A pillow according to claim 31, wherein the wings are fixed to one side of the bridging section, and the gripping member is fixed to the opposite side of the bridging section at least at portions that are opposite to portions of the bridging section to which the wings are fixed.

37. A pillow according to claim 31, wherein the wings are fixed to one side of the bridging section, and the gripping member is fixed to the opposite side of the bridging section between portions that are opposite to portions of the bridging section to which the wings are fixed.

38. A pillow according to claim 31, wherein the gripping member is fixed to the bridging section along the outer peripheral surface.

* * * * *